US008460071B2

(12) United States Patent
Masseilot

(10) Patent No.: US 8,460,071 B2
(45) Date of Patent: Jun. 11, 2013

(54) HAND HELD SHARPENING DEVICE

(76) Inventor: Horacio Masseilot, Buenos Aires (AR)

( * ) Notice: Subject to any disclaimer, the term of this patent is extended or adjusted under 35 U.S.C. 154(b) by 927 days.

(21) Appl. No.: 12/229,370

(22) Filed: Aug. 22, 2008

(65) Prior Publication Data

US 2009/0064508 A1 Mar. 12, 2009

(30) Foreign Application Priority Data

Aug. 30, 2007 (AR) ..... P20070103851

(51) Int. Cl.
*B24D 15/08* (2006.01)
*B24B 1/00* (2006.01)

(52) U.S. Cl.
USPC ..... 451/524; 30/350; 30/357; 451/45; 451/557

(58) Field of Classification Search
USPC .... 30/350, 357; 76/82.2, 82; 419/18; 451/45, 451/321, 322, 523, 524, 557
See application file for complete search history.

(56) References Cited

U.S. PATENT DOCUMENTS

| | | | | | |
|---|---|---|---|---|---|
| 2,398,255 | A | * | 4/1946 | Schauble et al. | 451/557 |
| 2,458,856 | A | * | 1/1949 | Jacobson | 451/555 |
| 3,553,905 | A | * | 1/1971 | Lemelson | 451/541 |
| 3,956,856 | A | * | 5/1976 | Yonkers | 451/164 |
| 3,956,858 | A | * | 5/1976 | Catlin et al. | 451/525 |
| 4,538,382 | A | * | 9/1985 | Johannsen | 451/175 |
| 4,558,540 | A | * | 12/1985 | Collins | 451/555 |
| 4,731,953 | A | * | 3/1988 | Owen | 451/163 |
| 5,431,068 | A | * | 7/1995 | Alsch | 76/82 |
| 5,445,050 | A | * | 8/1995 | Owens | 76/83 |
| D363,869 | S | * | 11/1995 | Ross | D8/93 |
| 5,588,340 | A | * | 12/1996 | Hancock | 76/82 |
| 2008/0171504 | A1 | * | 7/2008 | Smith | 451/540 |

* cited by examiner

*Primary Examiner* — Timothy V Eley
(74) *Attorney, Agent, or Firm* — Defillo & Associates, Inc.; Evelyn A. Defillo

(57) ABSTRACT

This invention is a manual sharpening device for knife blades that creates a micro-serrated edge on the cutting edge of a knife (microscopic saw). There are two types of knife blades on the world market: plain (flat cutting surface) and serrated (undulated cutting surface, also known as saw knives). Each has a wide range of shapes and sizes for various applications. This sharpening tool allows the user to create a cutting edge on any knife that combines the effects of the plain and serrated edge and thereby expands the potential applications of any knife.

3 Claims, 1 Drawing Sheet

HAND HELD SHARPENING DEVICE

BACKGROUND OF THE INVENTION

This invention relates to a hand-held sharpening device, more precisely to a manual device for sharpening knife blades. There are two types of knife blades on the world market: plain (flat cutting surface) and serrated (undulated cutting surface, also known as saw knives); having each a wide range of shapes and sizes. Each thing to be cut will be more or less clearly favored by one of these. As an example we know that meat is best cut with a plain edge knife and bread with a serrated-edge knife.

This sharpening tool creates a micro-serrated edge (7) on the cut-surface (microscopic saw) where the effects of the plain and serrated blades are combined. This makes the penetration of the knife easier, which becomes even more noticeable when the thing is more "difficult" to cut.

There are surfaces which usually present difficulties at the time of cutting, one of which is, for example, the tomato skin. However, even using a low quality knife sharpened with this tool, the cut of a tomato of any variety will be made without any difficulty even in thin slices, which indicates the little pressure made in the cut. The "secret" consists in that the pressure made on the knife will not be applied on a continuous blade whose big contact surface tends to "squish" the thing to be cut, but which will be microscopic sharpened segments, which like points, will "prick" the object making it easier for the knife to penetrate it. Such penetration will clearly happen with a lower pressure in the cut compared to a traditional sharpening. With this invention we can achieve a serrated knife cutting edge and therefore the advantages mentioned above.

BRIEF SUMMARY OF THE INVENTION

The Hand Held Sharpening Device is a manual device for the sharpening of knife blades made up of a handle used as a support element in whose inferior part a portion of a metallic blade is fitted, which has a straight edge in its external part partially covered by an abrasive powder which is strongly adhered to such edge.

DETAILED DESCRIPTION OF THE INVENTION

Figure 1:
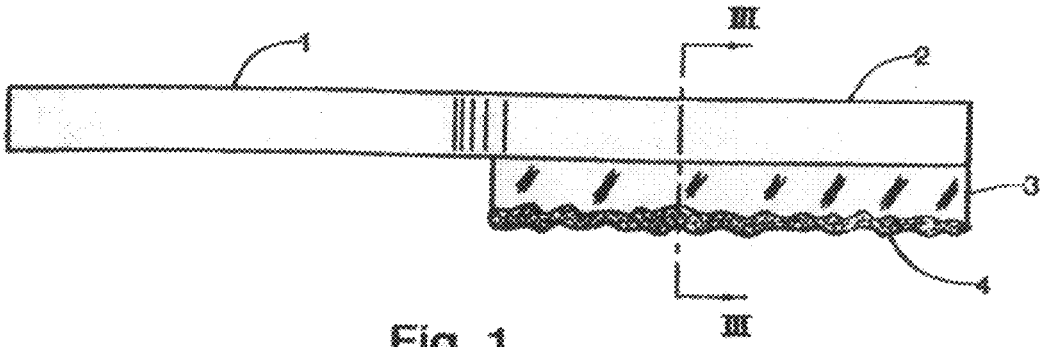
FIG. 1: Illustrates a perspective front view of the hand held sharpening device according to the present invention.
Figure 2:
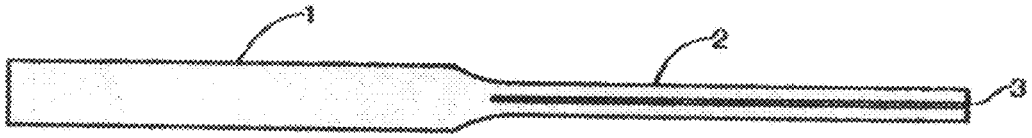
FIG. 2: Illustrates a bottom view of the hand held sharpening device of FIG. 1.
Figure 3:
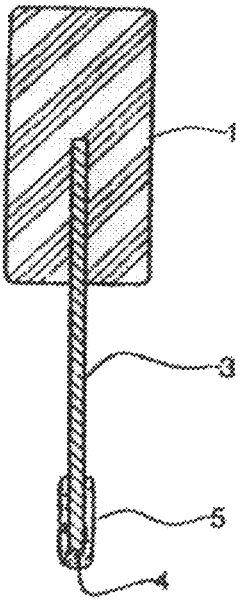
FIG. 3: Illustrates a cross sectional view of the hand held sharpening device taken along line III-III in FIG. 1.
Figure 4:
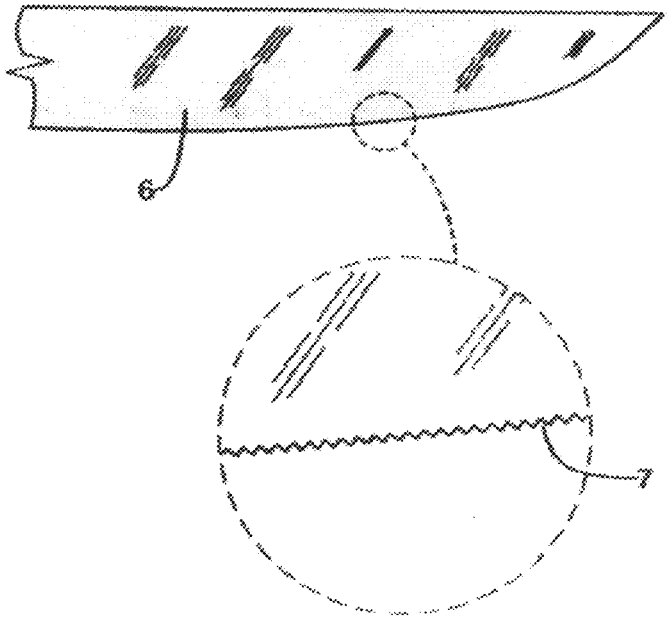
FIG. 4: Illustrates a detail of the cutting edge obtained with the hand held sharpening device.

The hand held sharpening device comprises a part as a clamping means fixed to a long support element in which a portion of a blade is fitted which has a straight edge in its external part partially covered with an abrasive powder (3) strongly adhered to such edge. The sharpener of this invention is composed of a handle (1), which prolongs into an element (2) of support of a blade (3) which is partially fitted in such support element (2). The handle (1) has a functional shape to grip the device tightly and the material which the handle (1) as well as the support element (2) are made of has to be of a rigidity similar to that of wood or the plastic material used in this kind of tools. The blade (3) has an (4) edge which is partially covered with an abrasive powder (5) strongly adhered to such edge. The abrasive powder (5) is tungsten carbide powder with variable grits and the method to achieve adherence to the blade (3) is by means of sinterization.

The invention claimed is:

1. A hand-held sharpening device comprising:

a rigid elongated handle having a first end, a second end, and a slot extending longitudinally on the second end;

a metallic blade, the metallic blade having a first longitudinal edge fitted in the slot of the second end of the rigid elongated handle and a second longitudinal edge, the metallic blade protruding from the second end of the rigid elongated handle, whereby the second longitudinal edge is completely exposed;

the second longitudinal edge is covered through its entire length by using sinterization with an abrasive composition consisting of tungsten carbide having variable grits; and the hand-held sharpening device is a knife sharpener.

2. A hand-held sharpening device comprising:

a rigid elongated handle having a first end, a second end, and a slot extending longitudinally on the second end;

protruding away completely from the second end of the rigid elongated handle;

a metallic blade, the metallic blade having a first longitudinal edge fitted in the slot of the second end of the rigid elongated handle and a second longitudinal edge, the metallic blade protruding from the second end of the rigid elongated handle, whereby the second longitudinal edge is completely exposed;

the second longitudinal edge is covered through its entire length by using sinterization with an abrasive composition consisting of tungsten carbide having variable grits; and the hand-held sharpening device is designed to produce a micro-serrated edge on a straight edge of a knife being sharpened; and the hand-held sharpening device is a knife sharpener.

3. A hand-held sharpening device consisting of:

a rigid elongated handle having a first end, a second end, and a slot extending longitudinally on the second end; and a metallic blade, the metallic blade having a first longitudinal edge fitted in the slot of the second end of the rigid elongated handle and a second longitudinal edge, the metallic blade protruding from the second end of the rigid elongated handle, whereby the second longitudinal edge is completely exposed;

the second longitudinal edge is covered through its entire length by using sinterization with abrasive composition consisting of tungsten carbide having variable grits; and the hand-held sharpening device is a knife sharpener.

* * * * *